US007204488B2

(12) United States Patent
Ilievski

(10) Patent No.: US 7,204,488 B2
(45) Date of Patent: Apr. 17, 2007

(54) ALPHABETIC ROULETTE GAME

(76) Inventor: Budimir Ilievski, 940 Logan Ave., Elgin, IL (US) 60120

( * ) Notice: Subject to any disclaimer, the term of this patent is extended or adjusted under 35 U.S.C. 154(b) by 43 days.

(21) Appl. No.: 11/123,014

(22) Filed: May 6, 2005

(65) Prior Publication Data

US 2005/0285336 A1 Dec. 29, 2005

Related U.S. Application Data

(60) Provisional application No. 60/582,071, filed on Jun. 24, 2004.

(51) Int. Cl.
*A63F 3/00* (2006.01)

(52) U.S. Cl. ..... 273/143 R; 273/309

(58) Field of Classification Search ..... 273/143 R, 273/309; 463/1

See application file for complete search history.

(56) References Cited

U.S. PATENT DOCUMENTS

| | | | | |
|---|---|---|---|---|
| 4,222,561 | A | 9/1980 | Whitten | |
| 4,560,171 | A | 12/1985 | Anthony | |
| 4,666,160 | A | 5/1987 | Hamilton | |
| 4,887,819 | A | 12/1989 | Walker | |
| 4,911,448 | A | 3/1990 | Thomas | |
| 5,553,853 | A | 9/1996 | Sackitey | |
| 6,059,659 | A | 5/2000 | Busch et al. | |
| 6,164,647 | A | 12/2000 | Chee | |
| 6,467,770 | B1 | 10/2002 | Matosevic | |
| 6,659,462 | B1 * | 12/2003 | Scott | 273/274 |
| 6,663,106 | B1 | 12/2003 | Cosmi | |
| 6,722,978 | B2 | 4/2004 | Valenti | |
| 2003/0094752 | A1 | 5/2003 | Mathews | |

FOREIGN PATENT DOCUMENTS

| | | |
|---|---|---|
| FR | 2662950 | 12/1991 |
| GB | 2241900 | 9/1991 |

* cited by examiner

*Primary Examiner*—Vishu K. Mendiratta
(74) *Attorney, Agent, or Firm*—Richard C. Litman

(57) ABSTRACT

The alphabetic roulette game includes a roulette wheel having twenty-five positions thereon, comprising the twenty-six letters of the Roman alphabet and a double letter position. A wagering surface or table provides for the placement of wagers upon the chance of any of the single letters (or the double letters) or a letter of any of several groups of letters turning up on a spin of the wheel. The game also provides for wagers on the chance of a given letter turning up on two or more consecutive turns of the wheel. A further wagering opportunity is provided for wagering upon the chance of a letter within a given word or words (e.g., "LITTLE WHEEL") coming up on a turn of the wheel. The alphabetic positions on the wheel, and corresponding positions on the table, may be colored to allow players to place wagers on a color or colors, as desired.

13 Claims, 4 Drawing Sheets

ALPHABETIC ROULETTE GAME

CROSS-REFERENCE TO RELATED APPLICATION

This application claims the benefit of U.S. Provisional Patent Application Ser. No. 60/582,071, filed Jun. 24, 2004.

BACKGROUND OF THE INVENTION

1. Field of the Invention

The present invention relates generally to games of chance, and more particularly to novel variations on the roulette wheel and wagers placed thereon. The present invention comprises a roulette wheel essentially having the Roman alphabet thereon, rather than numbers; other alphabets may be used alternatively. A series of different wagers may be placed on the outcome of various letters or combinations of letters turning up on any given spin or series of spins of the wheel.

2. Description of the Related Art

The gambling and gaming industry has expanded considerably over the years, as more and more people have more free time and disposable income. Nonetheless, the gambling industry tends to be relatively conservative at its base, with essentially the same games being played over the years and generally with only minor variations on the methods or rules of play. As a result, there is greater familiarity with most of the various gambling games played throughout most of the casinos and gaming establishments throughout the U.S., and throughout the world, for that matter. This may be reassuring for the neophyte or infrequent player, who does not wish to learn new rules and who may feel uncomfortable with new games or rules. However, the proliferation of standard games throughout the industry may result in boredom for many experienced players who wish to try something new and different.

The present alphabetic roulette game provides a solution to this problem, in that it uses tried and true, conventional roulette wheel technology, which is familiar to all gamblers. However, rather than placing numbers on the wheel, the present invention displays the twenty-six letters of the Roman alphabet in twenty-five positions on the wheel, with the letters Y and Z combined as a single position. Other arrangements and/or alphabets may be used as desired. The present invention provides a series of different wagers that cannot be played on a numerical roulette wheel, such as wagering on the probability of any single letter in a group of letters forming a word, turning up on the wheel. Other wagers similar to those used in conventional numerical roulette may be played as well, e.g., "line" wagers, "street" wagers, etc., but with the wagers being placed upon consecutive runs or groups of letters, rather than upon numbers, as in conventional roulette. Moreover, multiple colors may be applied to the wheel positions as desired, to allow players to place wagers on a color or colors as desired.

A discussion of the related art of which the present inventor is aware, and its differences and distinctions from the present invention, is provided below.

U.S. Pat. No. 4,222,561 published on Sep. 16, 1980 to Hubert N. Whitten, titled "Game Device," describes a roulette type wheel with a series of letters of the Roman alphabet thereon. The Whitten wheel includes a total of thirty-six lettered positions thereon, with many of the letters obviously being duplicated. This teaches away from the present invention, with its use of unduplicated letters in all positions. The Whitten wheel cannot be used for wagering without unduly complicating the odds calculations for players, due to the greater chance of certain letters coming up than others. In fact, Whitten does not disclose any form of wagering on his alphabetic wheel. Rather, he uses a letter randomly selected by his wheel to designate the first letter of an object from a group of related objects, e.g., kinds of fruit, etc. The subject player must come up with an object having a name that begins with the letter selected on the Whitten roulette wheel in order to win that particular play or turn. Whitten does not provide any means of wagering upon single letters or groups of letters, either in consecutive order or forming a word, which features are parts of the present invention.

U.S. Pat. No. 4,560,171 issued on Dec. 24, 1985 to Zacharias Anthony, titled "Poker Game," describes a game having a series of boards or cards, each having fifty-three positions thereon. Representations of the fifty-two cards of a standard deck are placed thereon with a double position provided for a joker or wild card. Each position has a corresponding number. A roulette wheel is marked with fifty-two to fifty-four numbers (depending upon the number of joker or wild card positions) corresponding to the numbers on the game boards. The wheel is used to randomly select cards to form hands for playing. While Anthony notes that the alphabet could be used to indicate the correspondence between the wheel and game board positions, he does not base any form of wagering upon the outcome of such an alphabetically labeled wheel, per se. Rather, the alphabetic indications referred to by Anthony are strictly for the identification of the corresponding card positions on his game boards, where such an alphabetic system is used.

U.S. Pat. No. 4,666,160 issued on May 19, 1987 to Clarence Q. Hamilton, titled "Apparatus For Playing," describes a large number of variations on mancala and vectorial type games. At least one embodiment includes a circular playing area with a limited, lettered periphery (shown in FIG. 12 of the '160 patent), but there is no provision for selecting letters randomly from the board, nor is there any disclosure of any wagering system or payout odds for wagers upon a lettered wheel, as provided by the present invention.

U.S. Pat. No. 4,887,819 issued on Dec. 19, 1989 to John A. Walker, titled "Casino Board Game," describes a relatively complex game, which includes a roulette wheel and combines aspects of several different traditional or conventional gambling games. No alphabetic layout for the roulette wheel is disclosed by Walker, nor does he provide any means for wagering upon any alphabetic outcome in using such a wheel.

U.S. Pat. No. 4,911,448 issued on Mar. 27, 1990 to Benny Thomas, titled "Spinner Device," describes a wheel containing all of the letters of the Roman alphabet, with no duplication or omissions. The wheel is used to select a letter randomly, with players being required to develop a list of words that begin with the randomly selected letter. No wagering systems of any kind are disclosed by Thomas. The Thomas game more closely resembles the game of the '561 U.S. Patent to Whitten, described further above, than it does the present invention.

U.S. Pat. No. 5,553,853 issued on Sep. 10, 1996 to Solomon K. Sackitey, titled "Game Apparatus And Method Of Play For Teaching DNA Related Technologies," describes a roulette type wheel having a series of seventy-one lettered positions thereon. Most of the letters of the alphabet are repeated, with several letters (B, J, U, X, and Z) being omitted from the wheel. The omission of any letters makes it impossible to place wagers upon any sequences that may be developed using the present alphabetic roulette wheel. Accordingly, Sackitey does not disclose any form of wagering upon the outcome of a spin(s) of his wheel. Rather, the Sackitey wheel is used as a teaching tool, using the randomly selected letters to represent nucleotides, which are used to develop a hypothetical DNA sequence.

U.S. Pat. No. 6,059,659 issued on May 9, 2000 to Steven L. Busch et al., titled "Roulette Table Having Progressive Jackpots," describes a game in which players place wagers upon the prospect of a single number coming up consecutively for some predetermined number of turns of the wheel. Players do not have the option of passing after some number of plays before reaching the predetermined number of spins of the wheel for the jackpot. No disclosure is made of any provision for using alphabetic characters and/or color in the Busch et al. roulette game.

U.S. Pat. No. 6,164,647 issued on Dec. 26, 2000 to Ah-Him Chong Toc Chee, titled "Casino Wheel Game System," describes a mechanically complex roulette wheel comprising upper and lower wheels, which may be randomly joined to select a specific color and number outcome on the lower wheel. No alphabetic designations on the wheel are disclosed, nor is any form of wagering or odds disclosed by Chee for his wheel.

U.S. Pat. No. 6,467,770 issued on Oct. 22, 2002 to Anto Matosevic, titled "Roulette Game," describes an essentially conventional roulette wheel with some additional provisions. No alphabetic wheel layout is disclosed, nor does Matosevic provide any means for placing wagers upon the probability of any letter or letters turning up during play.

U.S. Pat. No. 6,659,462 issued on Dec. 9, 2003 to Timothy J. Scott, titled "Game And Game Table," describes a relatively complex game involving cards for the first portion of the game and a pair of concentric roulette wheels for the second portion. One wheel includes the letters of the alphabet and an additional two or three "house" positions, which greatly increases the odds in favor of the house. The other wheel is used to determine the payout odds. In the present game, the odds are already established by the probability of any of the letters coming up in a given spin of the single wheel provided. Scott does not disclose any system for wagering upon any of the combinations of letters, as provided by the present alphabetic roulette game invention.

U.S. Pat. No. 6,663,106 issued on Dec. 16, 2003 to Giuseppe Cosmi, titled "Roulette Of Improved Type And New Gambling Game Providing For The Use Of Said Improved Roulette," describes the use of two concentric wheels, with one having thirty-two numerical positions thereon (including zero) and the other having the signs of the zodiac (European or Asian) thereon. Other markings or symbols may be provided in addition to the numerical and zodiac markings. Players must "hit" on winning positions on both wheels in order to maximize their winnings. Cosmi notes that alphabets and languages other than the Roman alphabet and English may be used for the various zodiac and other descriptions, but he does not disclose a wheel having solely an alphabetic pattern thereon to designate the different potential positions on the wheel, nor does he disclose any form of wagers for such a wheel.

U.S. Pat. No. 6,722,978 issued on Apr. 20, 2004 to Mark F. Valenti, titled "Method Of Playing A Linked Numerical Game Of Chance With A Bonus And Parlay Wagering Option," describes a game that more closely resembles lotto than roulette. In any event no alphabetic roulette system or roulette game using colors is disclosed by Valenti.

U.S. Patent Publication No. 2003/94,752 published on May 22, 2003, titled "Method And Apparatus For Roulette-Type Games," describes a multiple ball roulette game in which four separate balls are played simultaneously. This results in considerably greater complication, when the possibility of four different balls alighting upon four different numbers is considered. However, Matthews does not disclose any form of alphabetic roulette wheel with his game. Only a conventional numbered roulette wheel is disclosed.

British Patent No. 2,241,900 published on Sep. 18, 1991, titled "Board Game," describes a game in which some form of randomizing device is used to select letters of the alphabet. The device may be a roulette wheel (not shown in the disclosure). A card designates the position of the letter in a word, with a word category having been previously determined. The player must come up with a word in the appropriate category and in which the randomly determined letter is in the proper position. No wagering system is disclosed by Pearlman.

Finally, French Patent No. 2,662,950 published on Dec. 13, 1991, titled "Educational Philatelic Game," describes (according to the drawings and English abstract) a game which utilizes a roulette wheel with positions representing characteristics of a country, along with various other components. The wheel is not shown, nor is there any indication of any alphabetic indicia used upon the wheel. No wagering system is apparent from the drawings and English abstract.

None of the above inventions and patents, taken either singly or in combination, is seen to describe the instant invention as claimed. Thus, an alphabetic roulette game solving the aforementioned problems is desired.

SUMMARY OF THE INVENTION

The present alphabetic roulette game includes a roulette wheel having each of the twenty-six letters of the Roman alphabet thereon. Each letter appears only once with no letters being omitted, with a single additional "YZ" (double letter) position of the same width as the other letter positions in order to provide an equal chance for the YZ position. The wheel thus has a total of twenty-five positions thereon. Other alphabets (Greek, Cyrillic, etc.) may be used alternatively, if so desired.

A wagering surface or table is provided, with the table having a series of positions thereon enabling gamblers to wager upon one or several of various different possible occurrences. The table allows players to wager on the chance of any single letter (or the YZ position) coming up, and/or on a letter contained in various groups of letters organized on the table. The present game also allows players to wager on the chance of any one of the letters in a given word (e.g., "LITTLE WHEEL") coming up, and on the same letter coming up on two or more consecutive turns. Such a progressive wagering system, i.e., wagering on the same letter coming up on consecutive spins of the wheel, may be applied to a conventional numbered roulette wheel as well.

These and other features of the present invention will be apparent upon consideration of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of an alphabetic roulette game, in which the roulette wheel is marked with the letters of the alphabet, rather than being numbered. A corresponding alphabetically marked wagering surface or table is also provided, upon which players may place wagers on the chance of various specific alphabetic outcome(s) from the spinning of the alphabetic roulette wheel.

Figure 1:
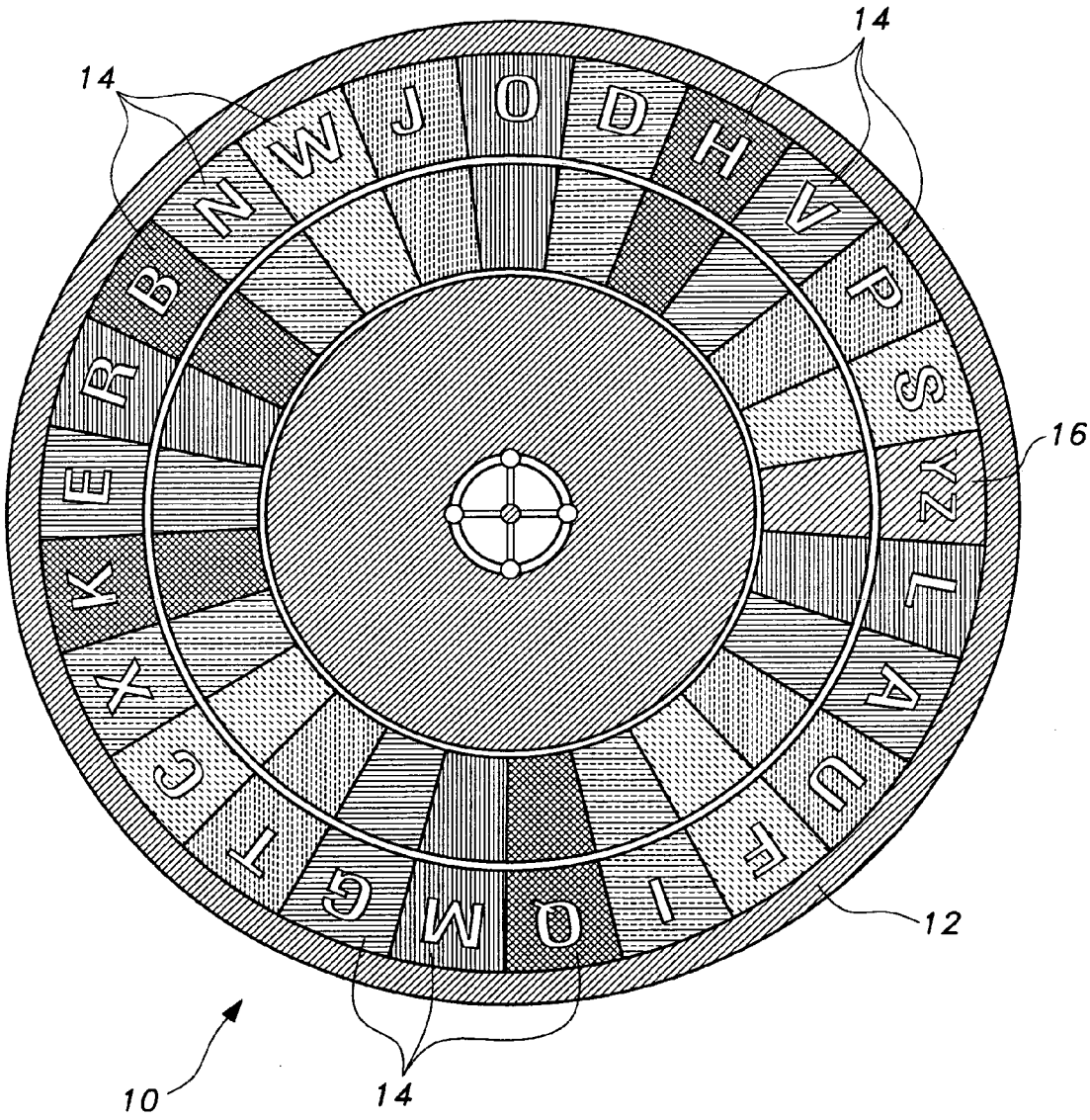
FIG. 1 is a top plan view of a roulette wheel incorporating the alphabetic configuration of the present invention.

FIG. 1 of the drawings provides a top plan view of the alphabetic roulette wheel 10 of the present invention, showing its general layout. The roulette wheel 10 includes a circumferential ring 12 having a series of evenly spaced positions 14 thereon, with each of the positions 14 containing a different letter of the alphabet. All letters are preferably provided for, with no duplications or omissions. The specific positions of the various letters may be randomized, as shown, or may be in some conventional (e.g., alphabetical, or vowel/consonant, etc.) order, if so desired.

In the case of the Roman alphabet embodiment illustrated in FIG. 1, a total of twenty-four single lettered positions 14 are provided, with an additional twenty-fifth "YZ" position 16 being provided as a casino "edge," much in the manner of the "0" and "00" positions on a conventional numbered roulette wheel. The "YZ" position 16 is preferably equal in width to each of the other twenty-four lettered positions, in order to provide equal odds of any of the twenty-five positions being randomly selected on any given play. While the twenty-six letter Roman alphabet is shown in the wheel 10 of FIG. 1, it will be seen that other alphabets (e.g., Greek, Cyrillic, Hebrew, etc.) may be used as desired without departing from the spirit of the present invention.

Figure 2:
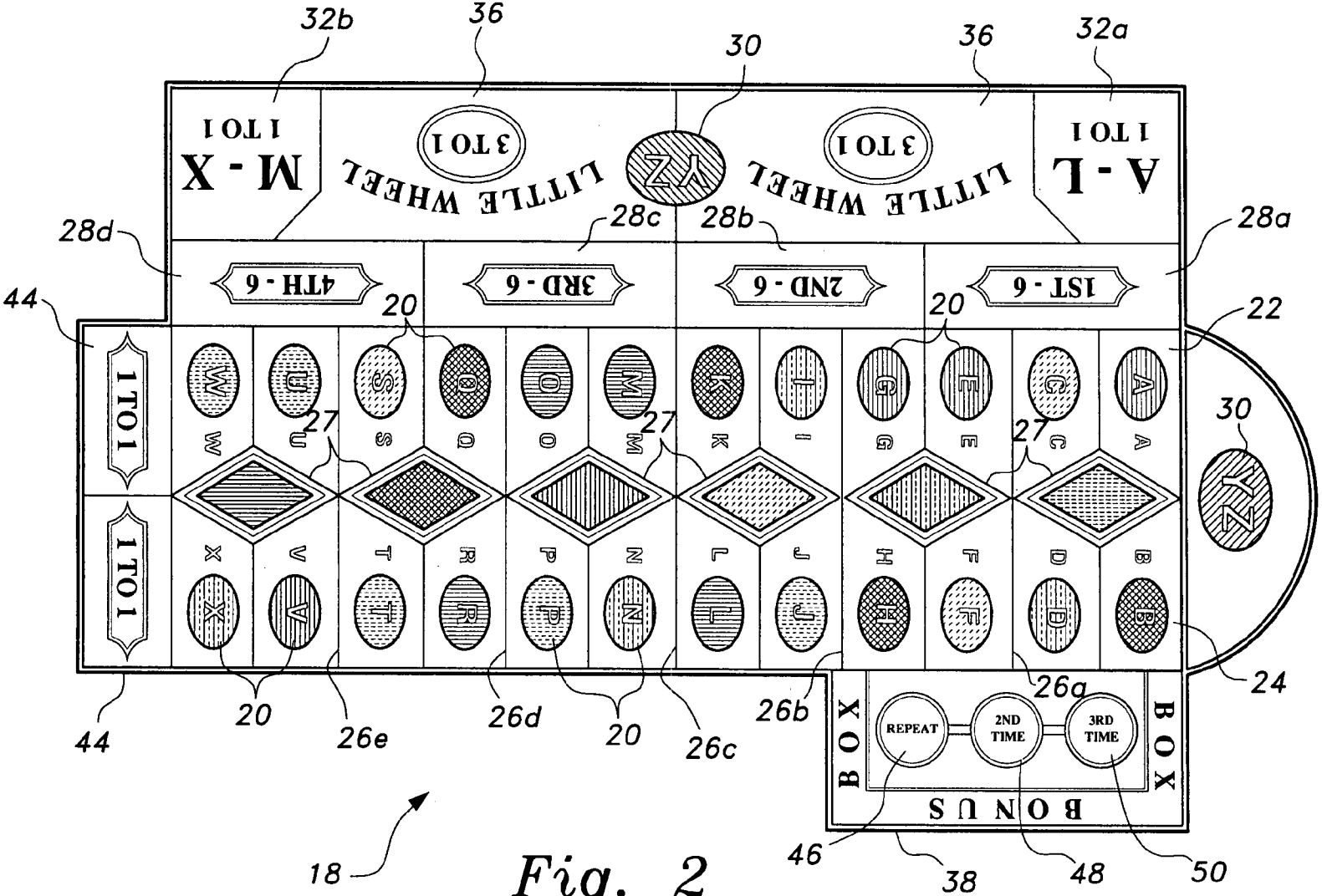
FIG. 2 is a top plan view of a wagering table or surface for use with the alphabetic roulette wheel of FIG. 1.

FIG. 2 provides an illustration of an exemplary wagering surface 18 or table that may be used with the present alphabetic roulette game. The wagering surface 18 includes a plurality of alphabetic positions 20 disposed thereon corresponding to the alphabetic positions 14 placed upon the roulette wheel 10 shown in FIG. 1. As noted in the case of the roulette wheel 10, the Roman alphabet is illustrated, but other alphabets may be used as desired, so long as the same alphabet is used for both the wheel 10 and the wagering surface 18.

The wagering surface 18 provides two columns 22 and 24 containing the letters of the alphabet. The letters alternate between each column, i.e., with A, C, E, . . . U, and W being in the first column 22, and B, D, F, . . . V, and X being in the second column 24. Other arrangements may be provided as desired. The letters may be encircled to indicate the position for placement of chips or tokens thereon for wagers on individual letters ("straight" bets). Smaller letters may be placed within each lettered area outside of the larger encircled letters, in order to indicate the letter within that area when the larger encircled letter is covered by one or more chips or tokens.

The twenty-four Roman alphabet letter positions 20 are further grouped into six groups of four by a series of lateral lines 26*a* through 26*e* extending across the two columns 22 and 24 and between vertically adjacent letter pairs. A wager placed upon the center of any of these bars or lines 26*a* through 26*e* at a point generally centered between four letters, i.e., a "corner" bet, indicates a bet that one of the four letters of that group will turn up on the next spin of the wheel 10. Each group of four letters is further distinguished by a colored diamond 27*a* through 27*f*. While each of the letters in any given four-letter group is colored differently from one another, players may place "color wagers" upon the differently colored diamonds in lieu of, or in addition to, alphabetic wagers on the letters. Any of the laterally adjacent letters of the two columns 22 and 24 also form pairs upon which wagers may be placed, if so desired.

One side of the wagering table, board, or surface 18 is marked with indicators for additional wagers on various group combinations of letters. Four groups of six letters each, respectively comprising the letter groups A through F, G through L, M through R, and S through X, are indicated by a series of "$1^{st}$ 6" through "$4^{th}$ 6" positions 28*a* through 28*d* along one side of the board or surface 18. The last two letters, i.e., "YZ," are positioned at one end and at one side of the table 18, at positions 30. Wagers may be placed upon any of these six letter groups, or on only the last two letters (i.e., the Y and Z pair), as desired. Further divisions of the letter positions 20 into first and second halves, i.e., the letters A through L forming a first half and the letters M through X forming a second half, are indicated by the "A–L" and "M–X" positions 32*a* and 32*b* along the left side of the wagering surface 18.

The wagering surface 18 also includes provisions for wagers upon the "YZ" position of the wheel 10, if so desired, as indicated by the "YZ" positions 30 in the central area and at the upper end of the surface 18. Normally, if the wheel turns up on the "YZ" position, all wagers go to the house or casino. However, players may place wagers upon this position, if they wish, in which case they win if the wheel stops on the "YZ" position. Two such "YZ" positions 30 are provided for the convenience of players situated at various areas of the wagering surface or table 18.

Letters, of course, are used to form words that have some meaning, as opposed to random groups or sequences of numbers. Accordingly, the present alphabetic roulette game may provide for wagers upon various letters that form a word or different words, as desired. In the example illustrated on the wagering surface 18 of FIG. 2, the words "LITTLE WHEEL" are provided as wagering words in a pair of identical word wager positions 36. This word represents the letters L, I, T, E, W, and H, and if the wheel 10 comes to rest upon any of those six letters, a player having placed a wager upon either of the "LITTLE WHEEL" positions, will win.

It will be seen that the present alphabetic roulette game lends itself to the inclusion of other words upon which wagers may be placed, as well. For example, a casino may wish to use the word "ROULETTE," or perhaps the name of their casino, as a wagering word (or one of several words, perhaps). Players may wish to place wagers upon the letters forming their name(s). The present game provides for such wagers, with the payout odds being adjusted in accordance with the number of non-repeating letters in a given name or word, e.g., the seven non-repeating letters in the word "ALPHABET" or the six non-repeating letters in the word "ROULETTE."

The wagering surface or table 18 of the present alphabetic roulette game may also provide for wagers on identical consecutive results, if so desired. A "bonus box" 38 may be provided on the wagering surface 18, enabling players to place wagers thereon in addition to wagers placed upon any of the letters or letter combinations permitted. The bonus position 38 allows players to bet that a letter will turn up two or more consecutive times. Payouts may be in accordance with the number of consecutive times that letter has come up. This wager is explained in more detail further below. Such progressive wagers on a series of wheel spin results may be applied to play on conventional numbered roulette wheels, as well.

Figure 3A:
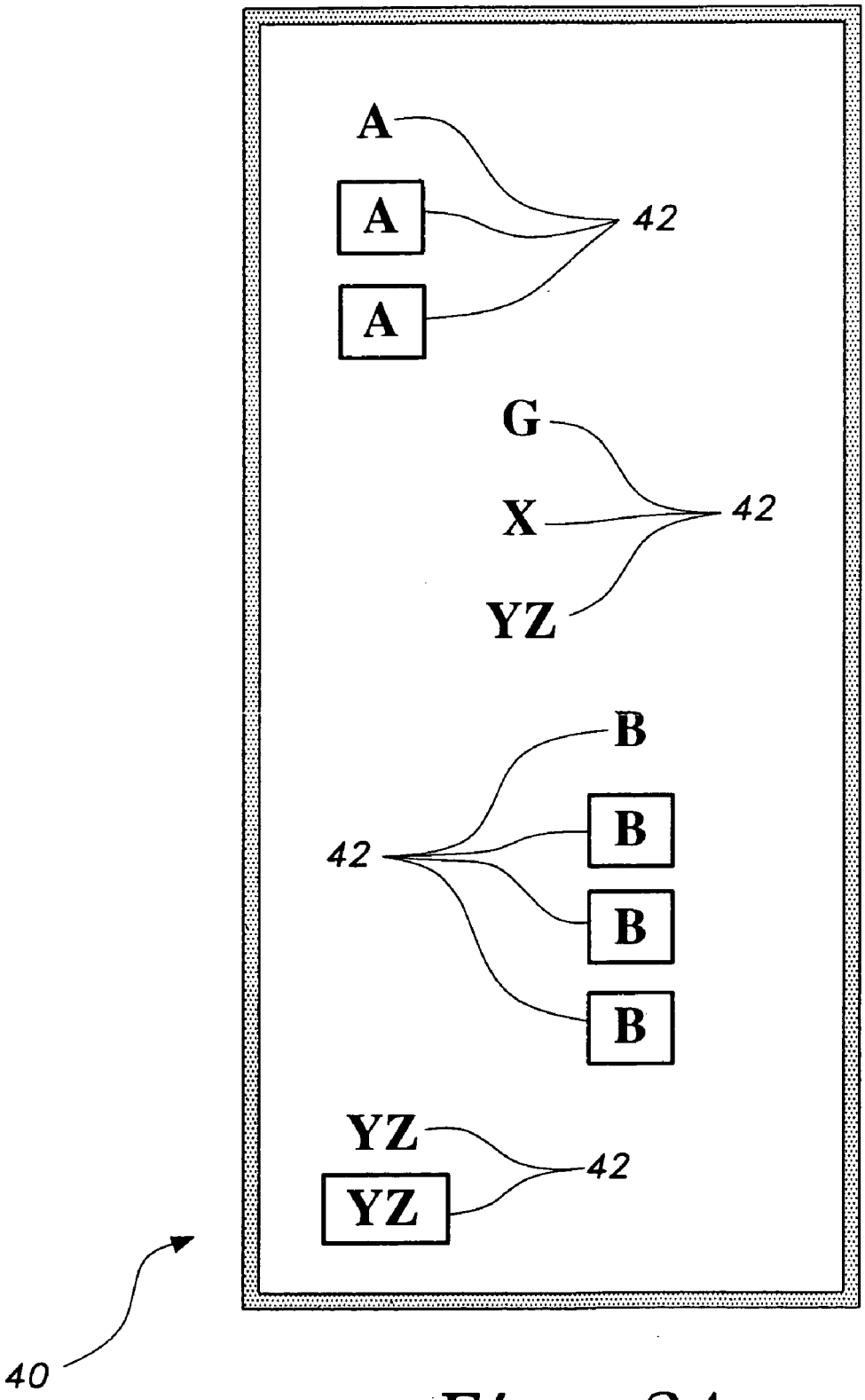
FIG. 3A is a representation of a history display board, showing exemplary results for the past several spins of the alphabetic roulette wheel of FIG. 1.
Figure 3B:
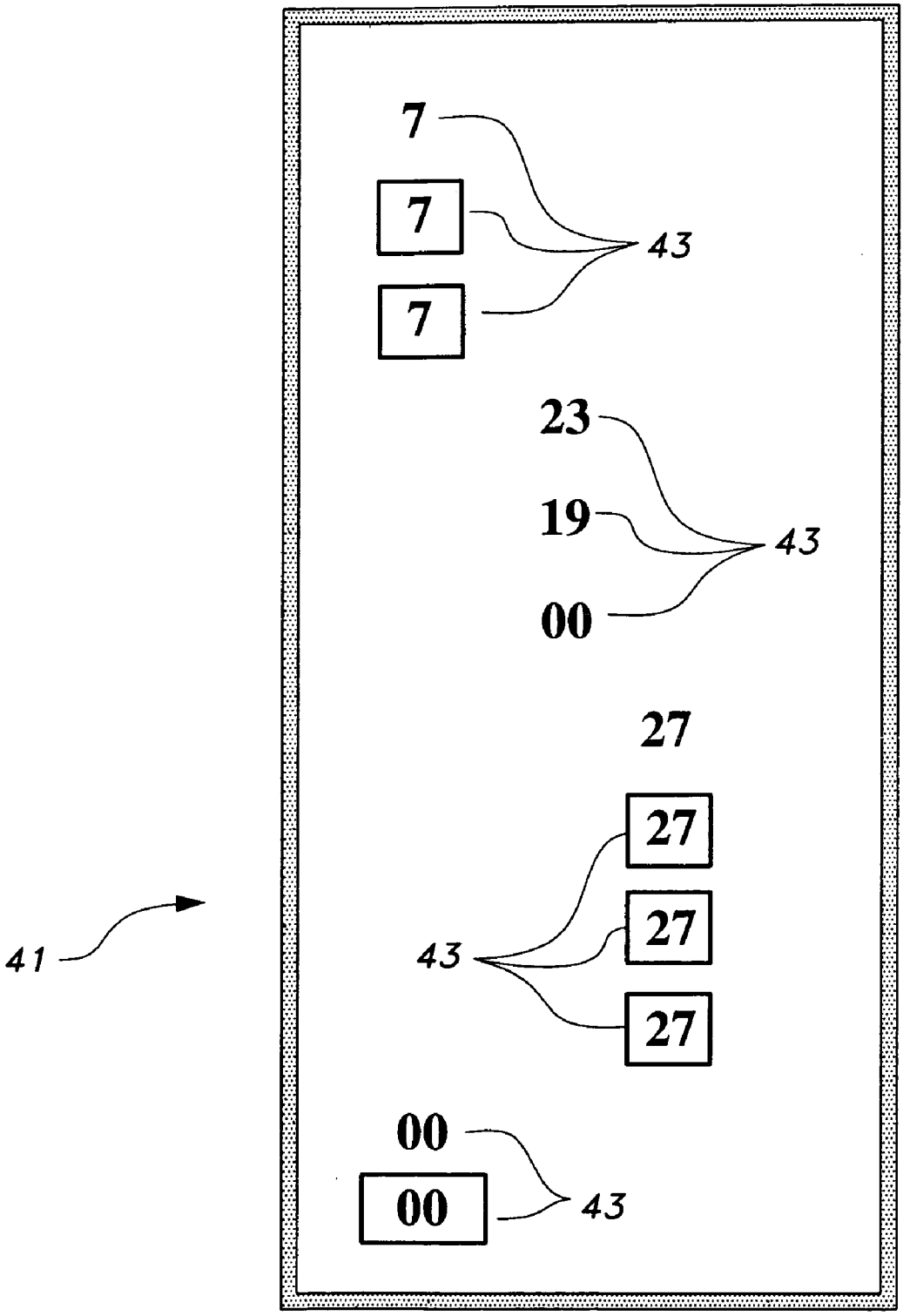
FIG. 3B is a representation of a history display board, showing exemplary results for the past several spins of a conventional numbered roulette wheel, for progressive play.

An alphabetic history display board 40 (an example of which is shown in FIG. 3A) may be provided to display the winning letters (e.g., letters 42 on the board 40) which have come up over the past several plays or spins of the wheel 10. Such display boards are conventional and well known in the art of numerical roulette gaming, and are generally actuated by electronic means which sense the winning position on the conventional numerical roulette wheel. Such a history display board 40 configured to track and display the past several consecutive results of the alphabetic roulette wheel 10, may be used to verify results for payment or collection of wagers placed upon the bonus positions 38 of the wagering table or surface 18. In the history display board 40 example of FIG. 3A, unrepeated letter results are shown as open letters, i.e., without any enclosures therearound. However, when a letter repeats consecutively, it is enclosed by a box, in order to provide a readily visible indication of such repeats. Other means of designating repeated letters, e.g., different colors, backgrounds, letter fonts, etc., may be provided as desired. A similar numerical history display board 41 is illustrated in FIG. 3B, for use in progressive play of wagers on consecutive numbers using a conventional numbered roulette wheel, e.g., the wheel disclosed in the Matthews '752 U.S. Patent Publication discussed further above, and incorporated herein by reference. Other numbered roulette wheel configurations may be used with the numbered history display board 41 of FIG. 3B, as desired.

The present alphabetic roulette game is played in accordance with the equipment illustrated in FIGS. 1 through 3B, and described further above. Players place one or more wagers upon the wagering table or surface 18, in accordance with the type and amount of wager they wish to place. (The chips or tokens of different players may be differentiated by color, shape, and/or other markings or means as desired, in order to avoid confusing the chips of different players.)

The simplest wager is a so-called "straight" wager, where a player places a wager upon only a single letter. Such a wager would have a one in twenty-five chance of winning, using the twenty-four single letters of the Roman alphabet and the single "YZ" position 16 on the wheel 10. Most payouts for the various wagers are rounded downwardly to the nearest one, two, or five points, with the remainder going to the house or casino as profit. Accordingly, a typical payout for a "straight" bet using the present alphabetic roulette game, might be twenty-three to one. However, it is not intended that the present disclosure limit the payouts for any of the wagers described herein.

Some players may wish to bet simultaneously upon two or more letters on the wagering surface 18. Accordingly, the various "streets," "splits," and other wagers described further above in the discussion of the wagering surface 18, may be used for the placement of such multiple letter bets. Perhaps the simplest of such wagers is the "split," where a player places his or her bet on the line between two vertically adjacent letters, e.g., the A and C in the upper left portion of the wagering surface 18 of FIG. 2. This doubles the chances of winning over a single letter bet to two out of twenty-five, or 1:12.5. A typical payout for a winning "split" wager, i.e., if either of the two letters comes up, is eleven to one. Similar wagers on two horizontally adjacent letters, i.e., a "street," may be made, with similar payout odds. A variation on such a "street" bet is the "top line" wager, in which players place their wager on the top line of the wagering surface 18, i.e., the line dividing the "A" and "B" ends of the two columns 22 and 24 and the adjacent "YZ" wagering position 30. This results in a wager that one of those three positions, i.e., A, B, or YZ, will turn up, with odds of 3:25, or 1:8.33, that such will occur. A typical payout might be 7:1 for such a "top line" bet.

Players may place wagers on larger groups of letters, as well. For example, a player may place one or more "corner" wagers on the central portion of the line 26*a* through 26*f*, which passes between letters forming groups of four. This designates a wager that any one of the four letter group upon which the wager has been centered will come up on the wheel 10. The odds of such an event occurring will be seen to be 4:25 on the alphabetic roulette wheel of FIG. 1, or 1:6.25. Payouts for such winning "corner" or "double street" wagers may be on the order of 5:1.

Yet another type of group wager is provided by the $1^{st}$·6 through $4^{th}$·6 positions 28*a* through 28*d* of the wagering surface 18 of FIG. 2. A wager upon any of these four positions is a bet that one of the six letters contained in that area, will turn up on the wheel 10. The odds of this occurring will be seen to be 6:25, or 1:4.17. A typical payout might be 3:1 or 4:1, to provide some profit for the house or casino.

Players may place wagers upon even larger groups of letters by placing wagers on either of the two columns 22 or 24 of alternating letters or upon either the first or second half of the alphabet by means of wagering positions 32*a* or 32*b*. The odds of a win for such a bet are only slightly less than even, due to the "YZ" position 16 on the wheel 10. Accordingly, payouts are even money, as indicated by the "1 to 1" positions 44 at the lower end of the wagering surface 18 in FIG. 2.

Players who wish to place a wager upon the possibility that one of the letters in a given word will come up on the wheel may do so by placing a wager on one of the "LITTLE WHEEL" positions 36 on the wagering surface 18. Such a wager is a bet that one of the six non-repeating letters in the words "LITTLE WHEEL" will come up on the wheel in the next turn. The odds of this occurring will be seen to be 6:25, or slightly better than 4:1 (i.e., between 3:1 and 4:1, but closer to 4:1). Accordingly, a typical payout might be 3:1 for a "LITTLE WHEEL" word win. As an added incentive for players to place wagers on the "LITTLE WHEEL" positions 36, some concession may be provided in the event that the YZ position 16 comes up on the wheel 10. Rather than losing their entire wagers, players may lose only half their wagers if they have placed them on the "LITTLE WHEEL" positions 36. Other adjustments to the odds and payouts may be made as desired.

It will be seen that other words may be used if desired, instead of, or in addition to, the words "LITTLE WHEEL." The casino running the present game may insert their own name, and/or players may find it fun to use their own names for wagering. Even if such a name is not specifically provided for on the wagering surface 18, players may place separate "straight" bets on the individual letters comprising their names, if so desired. The odds of winning are merely the number of different individual letters selected divided by the number of positions on the wheel 10. For example, the present inventor may elect to place a wager upon his given name, "BUDIMIR." This name includes six non-repeating letters, so the odds of winning (and typical payout for a win) are identical to those for a wager on any of the four $1^{st}$–6 through $4^{th}$–6 positions 28*a* through 28*d,* discussed further above.

After the various wagers have been placed in accordance with the above selections, the wheel 10 is spun and allowed to slow until it comes to rest upon one of the twenty-five positions 14 and 16 thereon (or more conventionally in casino establishments, until a selection ball, not shown, comes to rest in one of the lettered or "YZ" positions 14 and 16 on the wheel 10). Losing wagers are then collected, and payouts made to winners, in accordance with the above descriptions of the various wager possibilities provided by the present game.

The present alphabetic roulette game also permits progressive wagers, i.e., a wager that a given letter (or the YZ position) will come up on consecutive spins of the wheel. A player may initially place a wager upon such a chance by placing one or more chips on the "repeat" position 46 of the bonus box 38 on the wagering surface 18 of FIG. 2. This is a wager that any given winning letter on one wheel spin, will come up again on a second consecutive spin of the wheel. The process may be continued for as many turns or wheel spins as desired, perhaps with limits being set by the casino or controlling authority. Payouts for winning bonus bets are in accordance with the number of consecutive times the letter (or group of letters) has come up. The history display board 40 of FIG. 3A enables the casino and players to track the history of the past several spins, in order to verify whether or not a bonus payout situation has occurred.

For example, the letter "I" may come up on a first turn of the wheel 10. By placing a bet in the bonus box, that player is wagering that the letter "I" will come up on the next turn. If the letter I comes up a second consecutive time, the player wins at a 23:1 payout (for example). If the player wishes to continue to wager that the same letter, e.g., "I," will come up a third consecutive time, he or she places a wager on the "$2^{nd}$ time" position 48 (i.e., for the second repeat, three consecutive times). The odds of the "I" position coming up two consecutive times are 1/25×1/25,=1/625. A payout of e.g., 500:1 could be provided for the selected letter "I". A third wager on the letter coming up for a third repeat (fourth consecutive time) may be placed on the "$3^{rd}$ time" position 50 of the bonus box 38, with a correspondingly high payout, e.g., 10,000:1, for a successful wager.

The same bonus system may be used with wagers on groups of letters, depending upon any rules established by the casino and/or controlling authority, but with lower odds for payouts. For example, a player may place a wager upon one of the corner positions generally centered within a group of four letters on the wagering board 18. If one of the four selected letters comes up on the wheel 10 in two consecutive turns, the player collects a bonus payout of e.g., 5:1 for the second consecutive time one of the four letters turns up on the wheel 10. A subsequent third win on one of the same four letters comprising the selected "corner" combination, would result in a payout of 5:1 times 5:1, or 25:1; other odds may be used as desired. This process may be continued with the bonus payout multiplication factor being equal to the number of consecutive wins for the selected wager.

FIG. 3B provides an illustration of a slightly different history display board 41 displaying the history of the past several spins of a conventional numbered roulette wheel, as indicated by the series of winning numbers 43 displayed. Identical consecutive numbers in a series of turns may be indicated by boxes surrounding those numbers, just as in the case of the alphabetic history display board 40 of FIG. 3A. Players may place wagers on the outcome of a series of consecutive spins of the numbered wheel in much the same way as described above for the present alphabetic roulette wheel 10, i.e., straight wagers, streets, corners, etc., as desired. The payouts for such progressive or bonus wagers may be generally as described for the alphabetic roulette progressive or bonus payouts, i.e., using the payout odds for the given wager multiplied by the number of times the number comes up consecutively. The payout odds will of course vary depending upon the number of numerical positions on the wheel and/or the odds provided by the casino or gambling establishment. The same progressive wagering system may also be applied to wagers on the color positions 27 of the table 18, if so desired, with consecutive color matches of the colored letter positions on the wheel 10 over multiple spins, winning.

In conclusion, the present alphabetic roulette game provides a novel means for players to find new enjoyment in roulette gambling, and a novel means for gambling establishments and casinos to profit on such games. The attraction of placing wagers on combinations of letters, rather than numbers, is unique in the field of gambling, and will be much appreciated by players. One provision of the present game which players may find particularly attractive is the ability to place wagers upon various combinations of letters. Accordingly, players may wish to place wagers upon the possibility of one of their initials coming up, or perhaps place wagers upon all of the letters in their names or upon letters of words spelling various words of importance to them. This feature will add an element of attraction and enjoyment to the field of roulette gambling, which has been unattainable by means of conventional numerical roulette wheels.

It is to be understood that the present invention is not limited to the embodiments described above, but encompasses any and all embodiments within the scope of the following claims.

I claim:

1. An alphabetic roulette game, comprising:

a roulette wheel having a plurality of evenly spaced alphabetic positions disposed on the wheel, the positions having a one-to-one correspondence to the letters of an alphabet; and a wagering surface having a plurality of alphabetic positions disposed upon the surface corresponding to the alphabetic positions of the roulette wheel, wherein each of said plurality of alphabetic positions includes first and second wagering placement regions bearing same letter of the alphabet thereby permitting viewing of one of the placement regions when the other one of the wagering placement regions is covered during wagering thereon.

2. The alphabetic roulette game according to claim 1, wherein said plurality of alphabetic positions upon said roulette wheel and upon said wagering surface comprises the twenty-six letters of the Roman alphabet.

3. The alphabetic roulette game according to claim 1, further including at least one double letter position disposed upon said roulette wheel, said at least one double letter position having a width equal to that of each of said plurality of alphabetic positions of said roulette wheel.

4. The alphabetic roulette game according to claim 1, further including:

a plurality of at least four different colors disposed upon said plurality of alphabetic positions of said roulette wheel;

a plurality of colors disposed upon said plurality of alphabetic positions of said wagering surface, each of the alphabetic positions having a single color, corresponding alphabetic positions of said roulette wheel and said wagering surface having identical colors to one another; and a plurality of group letter wagering positions disposed upon said wagering surface.

5. The alphabetic roulette game according to claim 4, wherein said group letter wagering positions of said wagering surface further comprise:

first alphabet half and second alphabet half wagering groups comprising the letters A through L and M through X, respectively;

first column and second column wagering groups comprising alternating letters of the alphabet, respectively;

a plurality of six letter wagering groups comprising the letters A through F, G through L, M through R, and S through X, respectively;

a plurality of adjacent four letter wagering groups; and a plurality of adjacent two letter wagering groups.

6. The alphabetic roulette game according to claim 4, wherein said group letter wagering positions of said wagering surface further include means forming a word thereby permitting wagering on the occurrence of the wheel stopping at an alphabetic position contained within said word.

7. The alphabetic roulette game according to claim 1, further including at least one multiple turn wagering position disposed upon said wagering surface.

8. The alphabetic roulette game according to claim 1, further including an alphabetic history display board showing winning letters of a plurality of previous consecutive spins of said roulette wheel.

9. A method of playing an alphabetic roulette game, comprising the steps of:

(a) providing a roulette wheel having a plurality of evenly spaced alphabetic positions disposed upon the roulette wheel having a one-to-one correspondence to the letters of an alphabet;

(b) providing a wagering surface having at least a plurality of alphabetic positions disposed upon the surface corresponding to the alphabetic positions of the roulette wheel, wherein each of said plurality of alphabetic positions includes first and second wagering placement regions bearing same letter of the alphabet;

(c) placing and covering one of the first and second wagering placement regions during wagering placement, and permitting viewing of the other wagering placement region;

(d) spinning the roulette wheel;

(e) determining the randomly selected winning alphabetic position after spinning the roulette wheel; and (f) collecting any losing wagers and paying out any winning wagers in accordance with the winning alphabetic position of the roulette wheel and the at least one wager placed upon the wagering surface.

10. The method of playing an alphabetic roulette game according to claim 9, further including the steps of:

(a) coloring the plurality of alphabetic positions of the roulette wheel with a plurality of colors, using a single color for each of the positions;

(b) coloring each of the wagering positions of the wagering surface with a color corresponding to that used for the corresponding position of the roulette wheel;

(c) grouping the letters A through L and M through X into first alphabet half and second alphabet half wagering groups, respectively, on the wagering surface;

(d) grouping alternating letters of the alphabet into first column and second column wagering groups, respectively, on the wagering surface;

(e) grouping the letters A through F, G through L, M through R, and S through X to form a plurality of six letter wagering groups on the wagering surface;

(f) grouping adjacent letters on the wagering surface to form a plurality of four-letter wagering groups on the wagering surface;

(g) grouping adjacent letters on the wagering surface to form a plurality of two letter wagering groups on the wagering surface; and (h) continuing in accordance with steps (e) through (h) of claim 9.

11. The method of playing an alphabetic roulette game according to claim 9, further including the steps of:

(a) forming at least one word on the wagering surface, from a plurality of letters;

(b) placing a wager on said at least one word, wherein winning is based upon the wheel stopping on a letter in the word: and (c) continuing in accordance with steps (e) through (h) of the method of claim 9.

12. The method of playing an alphabetic roulette game according to claim 9, further including the steps of:

(a) providing at least one multiple turn wagering position disposed upon said wagering surface;

(b) placing at least one wager upon the multiple turn wagering position of the wagering surface;

(c) spinning the roulette wheel through a multiple number of plays;

(d) determining the randomly selected winning alphabetic position after each play;

(e) collecting any losing wagers when the randomly selected winning alphabetic position differs from play to play during the multiple number of plays; and (f) paying out any winning wagers when the same randomly selected winning alphabetic position occurs over the multiple number of plays.

13. The method of playing an alphabetic roulette game according to claim 12, further including the steps of:

(a) providing an alphabetic history display board; and (b) tracking the spin results of the previous multiple number of consecutive plays of the roulette wheel by means of the alphabetic history display board.

* * * * *